United States Patent [19]

Cousins

[11] Patent Number: 4,483,470

[45] Date of Patent: Nov. 20, 1984

[54] CONVERTABLE SLING-BELT SNAPPER FOR CARRYING ROLLER SKATES AND THE LIKE

[75] Inventor: Raymond H. Cousins, Cincinnati, Ohio

[73] Assignee: Leonard Williamson, Cincinnati, Ohio

[21] Appl. No.: 331,231

[22] Filed: Dec. 16, 1981

Related U.S. Application Data

[63] Continuation of Ser. No. 150,387, Jul. 1, 1980, abandoned.

[51] Int. Cl.[3] ..... B65D 63/00

[52] U.S. Cl. ..... 224/257; 211/34

[58] Field of Search ..... 224/257, 202, 255, 258, 224/264, 268, 908, 913; 211/34; 280/814, 825

[56] References Cited

U.S. PATENT DOCUMENTS

| | | | |
|---|---|---|---|
| 1,292,875 | 1/1919 | Randall | 224/913 X |
| 3,081,923 | 3/1963 | Bagby | 224/264 X |
| 3,587,951 | 6/1971 | Derouin | 224/45 S |
| 3,905,610 | 9/1975 | Dini | 224/45 S X |

FOREIGN PATENT DOCUMENTS

| | | | |
|---|---|---|---|
| 1198768 | 12/1959 | France | 224/202 |
| 86660 | 9/1920 | Switzerland | 224/202 |

*Primary Examiner*—Steven M. Pollard
*Attorney, Agent, or Firm*—Leonard Williamson

[57] ABSTRACT

A convertable sling-belt snapper for carrying a pair of roller skates and the like. The sling-belt including: (a) a strap, (b) a pair of snapper clamps, one clamp on each end of the strap, and (c) mating buckling members. The sling-belt is useful as a sling by using the clamps to clamp the roller skates, one on each end of the strap. The sling-belt is useful as a waist belt by buckling the strap around the waist when the user is not using it as a sling.

4 Claims, 3 Drawing Figures

CONVERTABLE SLING-BELT SNAPPER FOR CARRYING ROLLER SKATES AND THE LIKE

This is a continuation of application Ser. No. 150,387, filed July 1, 1980, now abandoned.

BACKGROUND

This invention relates to belts and slings. The sling is used to carry a pair of roller or ice skates, boots, or the like.

However, most skaters, e.g., tie the shoe strings of their skates together and use the strings as a sling to carry the skates over his or her shoulder. This practice causes rapid wear and stress to the shoe strings. This can also be very uncomfortable especially when heavy roller skates, e.g., are carried over long distances or for extended periods of time.

U.S. Pat. No. 3,587,951 to Deroiun June 28, 1971 relates to a boot sling device designed to solve the aforementioned wear and stress problem. Deroiun's device, however, appears to be bulky and somewhat cumbersome. When not in use as a sling, the device must be stored and is not convertable into a waist belt.

It is an object of the present invention to provide a sling that is convertable to a handsome waist belt when not in use as a sling.

Another object of the present invention is to provide a sling having a means for easily clamping or snapping onto boots, shoes, skates, and the like. As used herein, the terms "roller skates" or "skates" means shoes, boots, or skates and the like.

Other objects of the present invention will be apparent in the light of the following disclosure.

SUMMARY OF THE INVENTION

A convertable sling-belt snapper for carrying a pair of roller skates and the like. The sling-belt including: (a) a strap; (b) a pair of snapper clamps, one clamp on each end of the strap; and (c) mating buckling members. The sling-belt is useful as a sling by using the clamps to clamp the roller skates to each end of the strap. The sling-belt is useful as a waist belt by buckling the strap around the waist when the user is not using it as a sling.

The sling-belt preferably has a means for adjusting the length of the strap. The strap is preferably made of leather, cloth, or some other suitable flexible material, e.g., a plastic vinyl or synthetic leather.

DETAILED DESCRIPTION OF THE INVENTION

A convertable sling-belt for carrying a pair of roller skates and the like. The sling-belt including: (a) a strap; (b) a pair of clamps, one clamp on each end of the strap, which clamps are convertable to mating buckling members. The sling-belt is useful as a sling by using the clamps to clamp the roller skates to each end of the strap. The sling-belt is useful as a waist belt by buckling the strap around the waist when the user is not using it as a sling.

The sling-belt preferably has a means for adjusting the length of the strap. The strap is preferably made of leather, cloth, or some other suitable flexible material, e.g., a plastic vinyl or synthetic leather.

Although the strap is preferably made of leather or a leather-like material, it can be made of cloth, heavy rubber, or a combination of these materials. The strap can be a single piece of material or two, three, or more sectional pieces attached together by metal rings, rope, or the like.

Figure 1:
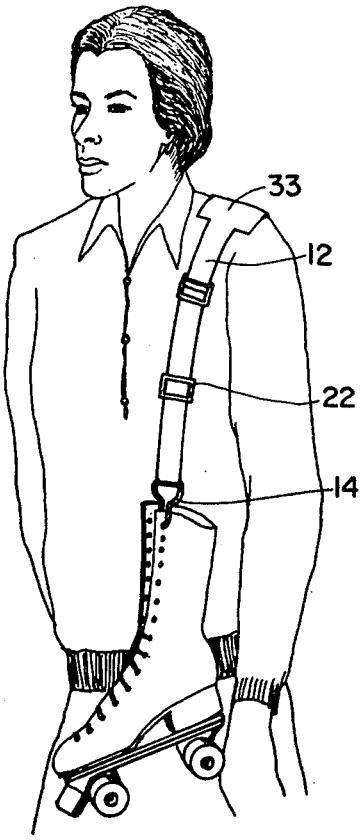
FIG. 1 is a pictorial view showing the sling-belt in use as a sling.
Figure 2:
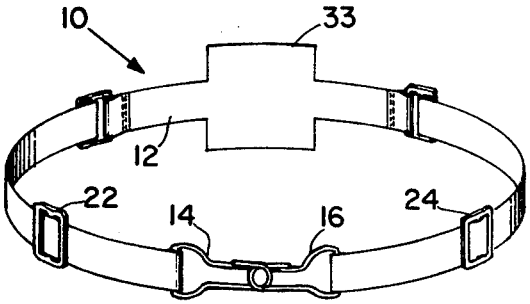
FIG. 2 is a pictorial view showing the sling-belt as it would be worn as a belt.
Figure 3:
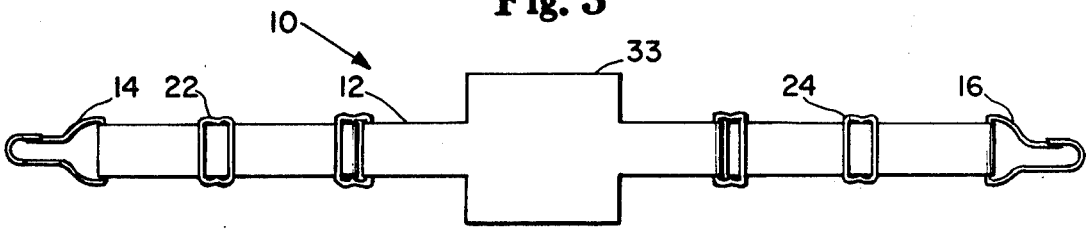
FIG. 3 is a perspective view of the sling-belt.

Referring now to the drawing, FIGS. 1–3 show a preferred embodiment of the convertable sling-belt which is indicated by the reference numeral 10. The sling-belt 10 includes a flexible strap member 12 with a pair of clamp means 14 and 16 located at each end of the strap member 12. One alternative clamp means is a clamp attached to the strap and adapted to clamp firmly onto a respective boot or skate whereby the boots may be carried by the sling. The pair of snap fastener clamp means 14 and 16 are convertable to mating buckling members 26 and 28. Frictional snubbing means 22 and 24 are used to adjust the length of the strap and thereby the fall of the skates and the size of the belt. The frictional snubbing means is optional.

Shoulder pad 33 is located at about the center of the strap 12 for comfort as a sling and fashion as a belt. The shoulder pad is optional.

A preferred clamp means is a snap fastener clamp, as shown, which is adapted to go through an eye or eyes of the skate or boot and clamp for security as shown.

I claim:

1. A convertable sling-belt including:

(a) a longated strap made of flexible material;

(b) a pair of clamp means, one of said clamp means being attached to one end of said strap and the other clamp means being attached to the other end of said strap, said clamp means being adapted to secure and hold a pair of roller skates, one skate on each end of said strap, for transporting;

(c) mating buckling members for buckling the strap around the waist of a user to wear the strap as a belt; and (d) whereby said strap when said clamping means are clamped onto said skates is useful as a sling; and (e) wherein said strap has an integral shoulder pad portion centrally located between said clamping means; and (f) whereby said strap when not used as a sling is convertable to a waist belt.

2. The sling-belt of claim 1 wherein said clamping means are convertable to said mating buckling members.

3. The sling-belt of claim 1 or 2 wherein said strap has a means for adjusting the length of said strap.

4. The sling-belt of claim 1 or 2 wherein said clamping means is a pair of snap fastener clamps.

* * * * *